US012503830B2

(12) United States Patent
Moore et al.

(10) Patent No.: US 12,503,830 B2
(45) Date of Patent: Dec. 23, 2025

(54) HYDRAULIC HAMMER

(71) Applicant: Caterpillar Inc., Peoria, IL (US)

(72) Inventors: Cody Thomas Moore, Robinson, TX (US); John Kevin Clemons, Wamego, KS (US)

(73) Assignee: Caterpillar Inc., Peoria, IL (US)

( * ) Notice: Subject to any disclaimer, the term of this patent is extended or adjusted under 35 U.S.C. 154(b) by 554 days.

(21) Appl. No.: 18/096,670

(22) Filed: Jan. 13, 2023

(65) Prior Publication Data

US 2024/0240431 A1 Jul. 18, 2024

(51) Int. Cl.
*E02F 3/96* (2006.01)

(52) U.S. Cl.
CPC ..... *E02F 3/966* (2013.01)

(58) Field of Classification Search
CPC .... B25D 9/04; B25D 9/145; B25D 2250/365; E02F 3/966
See application file for complete search history.

(56) References Cited

U.S. PATENT DOCUMENTS 5,075,950 A * 12/1991 Steinbock ..... B25B 29/02 29/446
6,056,070 A * 5/2000 Shinohara ..... B25D 9/145 173/133
8,141,655 B2 3/2012 Pillers, II
8,733,737 B2 * 5/2014 Lewandowski ..... F16K 15/063 137/220
9,321,161 B2 * 4/2016 Ceney ..... B25B 13/06
9,555,531 B2 * 1/2017 Moore ..... B25D 9/145
9,909,666 B2 * 3/2018 Moore ..... B25D 9/00
10,201,894 B2 * 2/2019 Moore ..... B25D 17/08
10,286,535 B2 * 5/2019 Moore ..... E02F 3/966
10,363,651 B2 * 7/2019 Moore ..... B25D 9/04
10,377,029 B2 * 8/2019 Moore ..... B25D 17/08
10,384,336 B2 * 8/2019 Grzybowski ..... E21B 1/38
10,562,166 B2 * 2/2020 Moore ..... B25D 9/145
11,389,916 B1 * 7/2022 Moore ..... F16B 31/04
(Continued)

FOREIGN PATENT DOCUMENTS

KR 101976200 B1 5/2019

OTHER PUBLICATIONS

Written Opinion and International Search Report for Int'l. Patent Appln. No. PCT/US2024/010249, mailed May 8, 2024 (11 pgs).

*Primary Examiner* — Thanh K Truong
*Assistant Examiner* — David G Shutty

(57) ABSTRACT

The power cell for a hammer may comprise a head, a cylinder and a piston. The head may include a main bore, a satellite bore and a lower retainer. The main bore includes an upper chamber that includes a trough, first and second furrows, and a lock wall. The trough may include a port that extends from the main bore into the satellite bore. The lock wall may extend between the furrows. The lower retainer may be disposed in the satellite bore, and may include a core member and a jut. The core member may include a bore configured to receive a fastener. The cylinder may include a body and a protrusion on the body. The cylinder may be rotatable, wherein when in a locked position the protrusion is disposed in the port, the fastener is received in the bore, and the protrusion abuts the lock wall and the jut.

20 Claims, 6 Drawing Sheets

(56) References Cited

U.S. PATENT DOCUMENTS

| | | | | |
|---|---|---|---|---|
| 2012/0152581 | A1 | 6/2012 | Pillers, II et al. | |
| 2014/0208575 | A1* | 7/2014 | Jagdale | E02F 3/966 411/103 |
| 2014/0332246 | A1 | 11/2014 | Moore et al. | |
| 2015/0360361 | A1 | 12/2015 | Gunasekaran et al. | |
| 2018/0133882 | A1* | 5/2018 | Moore | B25D 9/12 |
| 2018/0147708 | A1* | 5/2018 | Grzybowski | B25D 9/04 |

* cited by examiner

HYDRAULIC HAMMER

TECHNICAL FIELD

The present disclosure generally relates to hydraulic hammers, and more particularly, assembly of hydraulic hammers.

BACKGROUND

Hydraulic hammers are used in work sites to break up large hard objects before such objects can be moved away. Hydraulic hammers can be attached to various machines such as excavators, backhoes, tool carriers, or other like machines for the purpose of milling stone, concrete, and other construction materials. The hydraulic hammer is mounted to a boom of the machine and connected to a hydraulic system. High pressure fluid is then supplied to the hammer to drive a reciprocating piston and a work tool in contact with the piston.

Typically, the hammer assembly is powered by either a hydraulic or pneumatic pressure source. During a work or power stroke, high fluid pressure is applied to a first shoulder of a piston, thereby driving the piston in a forward direction. The piston then strikes a work tool, which is driven in the forward direction thereby causing a work tip of the tool to strike the rock, concrete, asphalt or other hard object to be broken up. During a return stroke, fluid pressure is applied to a second shoulder of the piston in order to return the piston to its original position.

A hydraulic hammer assembly, among other components, typically includes a housing and a head. The housing includes a work tool and a piston that reciprocates in the housing to strike the work tool. The housing may also contain necessary hydraulic circuit to drive the piston in the housing. The head includes, among other components, an accumulator for augmenting the strike power of the piston on the work tool. The accumulators provide for a biasing force to the piston towards the work tool. Generally, such accumulators have a pressurized gas, for example nitrogen, that is contained in a chamber of the head.

U.S. patent publication number US20120152581 discloses a demolition hammer with a head and a housing. In '581, external tie rods are used to tie the front head to the valve body. The tie rods increase the overall diameter of the hammer assembly and add to the complexity of the structure. Tie rods typically have to be replaced at regular service intervals, since they are subject to fatigue. Moreover, tie rods in a hammer also increase the overall time required for assembly or disassembly of the hammer. In addition, the disassembly of a hammer with tie rods may require special tools. A better hammer is desired.

SUMMARY OF THE DISCLOSURE

In one aspect of the present disclosure, a power cell of a hammer is disclosed. The power cell may comprise a head having a top end and a bottom end, a cylinder, and a piston. The head may include a main bore, a satellite bore and a lower retainer. The main bore may extend parallel to a longitudinal axis defined by the power cell. The main bore has an inner surface and includes an upper chamber disposed adjacent to the top end. The upper chamber may include a trough, a first furrow, a second furrow and a lock wall. The trough may be inset into the inner surface and may include a port that extends from the main bore into the satellite bore disposed in the head. Each of the first and second furrows may be inset into the inner surface and intersect the trough. The lock wall may be disposed adjacent the top end and extend between the first furrow and the second furrow. The lock wall may further extend from the top end to the port. The satellite bore may be disposed radially outward of the main bore. The lower retainer may be disposed in the satellite bore. The lower retainer may include a core member and a jut angled outward from the core member. The core member may include a bore configured to receive a fastener. The cylinder may include a body and a protrusion. The body may extend between a first end and a second end of the cylinder. The protrusion may be disposed on an outer surface of the body and adjacent to the first end. The first end of the cylinder may be disposed in the upper chamber. The cylinder may be rotatable in the upper chamber from an unlocked position to a locked position, wherein when in the locked position the protrusion is disposed in the port, wherein further when the cylinder is in the locked position and the fastener is received in the bore of the core, the protrusion abuts the lock wall and the jut. The piston may be disposed in the cylinder and configured to translate in a direction parallel to the longitudinal axis.

In another aspect of the disclosure, a method of assembling a power cell is disclosed. The power cell comprises a head and a cylinder. The head having a top end and including a main bore, a satellite bore, a lower retainer and a sealing member disposed on a shelf. The main bore may extend parallel to a longitudinal axis defined by the power cell and having an inner surface. The main bore may include an upper chamber disposed adjacent to the top end. The upper chamber may include a trough, a first furrow, a second furrow; a lock wall and the shelf. The trough may be inset into the inner surface and may include a port that extends from the main bore into the satellite bore. The first and second furrows may be inset into the inner surface and may intersect the trough. The lock wall may be disposed adjacent the top end and extend between the first and second furrows. The lock wall may further extend from the top end to the port. The satellite bore may be disposed radially outward of the main bore. The lower retainer may be disposed in the satellite bore and may include a core member and a jut angled outward from the core member. The core member may include a bore configured to receive a fastener. The cylinder may include a body and a protrusion. The body may extend between a first end and a second end of the cylinder. The protrusion may be disposed on an outer surface of the body and may be adjacent to the first end. The first end of the cylinder may be disposed in the upper chamber. The cylinder is rotatable in the upper chamber from an unlocked position to a locked position, wherein when the cylinder is in the locked position and the fastener is received in the bore of the core, the protrusion abuts the lock wall and the jut. The fastener may be a bolt, a threaded bolt or a screw. The method may comprise: sliding the protrusion of the cylinder into the first furrow until the first end of the cylinder rests against the sealing member; rotating the cylinder to the locked position in which the protrusion is disposed in the port; and urging the contact face of the jut and a first sidewall of the protrusion into compressive engagement with one another by tightening the fastener in the bore of the lower retainer.

In yet another aspect of the disclosure, a hammer is disclosed. The hammer may comprise a housing, a power cell disposed in the housing and defining a longitudinal axis, and a cylinder. The power cell may comprise: a head having a top end and a bottom end, a cylinder and a piston. The head may include: a main bore, a trough, a first furrow, a second furrow, a lock wall, a satellite bore, and a lower retainer. The main bore may extend parallel to the longitudinal axis. The main bore has an inner surface and may include an upper chamber disposed adjacent to the top end and a tool channel extending from the upper chamber to the bottom end of the head. The tool channel is configured to receive a work tool. The upper chamber may include: a trough, a first and second furrow, a lock wall, a satellite bore, a lower retainer. The trough may be inset into the inner surface and include a port that extends from the main bore into a satellite bore. The first and second furrows may be inset into the inner surface and may extend from the top end to intersect the trough. The lock wall may be disposed adjacent to the top end and may extend between the first furrow and the second furrow. The lock wall may include an upper face disposed at the top end and a lower face disposed adjacent to the port. The satellite bore may be disposed radially outward of the main bore and extend parallel to the longitudinal axis. The lower retainer may be disposed in the satellite bore. The lower retainer may include a core member and a jut angled outward from the core member. The jut may include a contact face. The core member may include a threaded bore configured to receive a fastener. The lower retainer may be configured to urge the contact face of the jut and a first sidewall of a protrusion into compressive engagement with one another when a fastener is threadingly received in the threaded bore and a cylinder is in a locked position. The cylinder may include a body and the protrusion. The body may extend between a first end and a second end of the cylinder. The protrusion may be disposed on an outer surface of the body and adjacent to the first end. The first end may be disposed inside the upper chamber. The protrusion may include a top surface that extends from the first sidewall to a second sidewall. The protrusion may extend through the port. The cylinder is rotatable in the upper chamber from an unlocked position to the locked position, wherein when the cylinder is in the locked position and the fastener is threadingly received in the threaded bore of the core member, the first sidewall of the protrusion extends through the port and is in compressive engagement with the contact face of the jut and the second sidewall of the protrusion is in compressive engagement with the lower face of the lock wall. The piston is disposed in the cylinder and configured to translate in a direction parallel to the longitudinal axis. The fastener may be a bolt, a threaded bolt or a screw.

DETAILED DESCRIPTION

Reference will now be made in detail to specific embodiments or features, examples of which are illustrated in the accompanying drawings. Generally, corresponding reference numbers will be used throughout the drawings to refer to the same or corresponding parts, unless otherwise specified.

Figure 1:
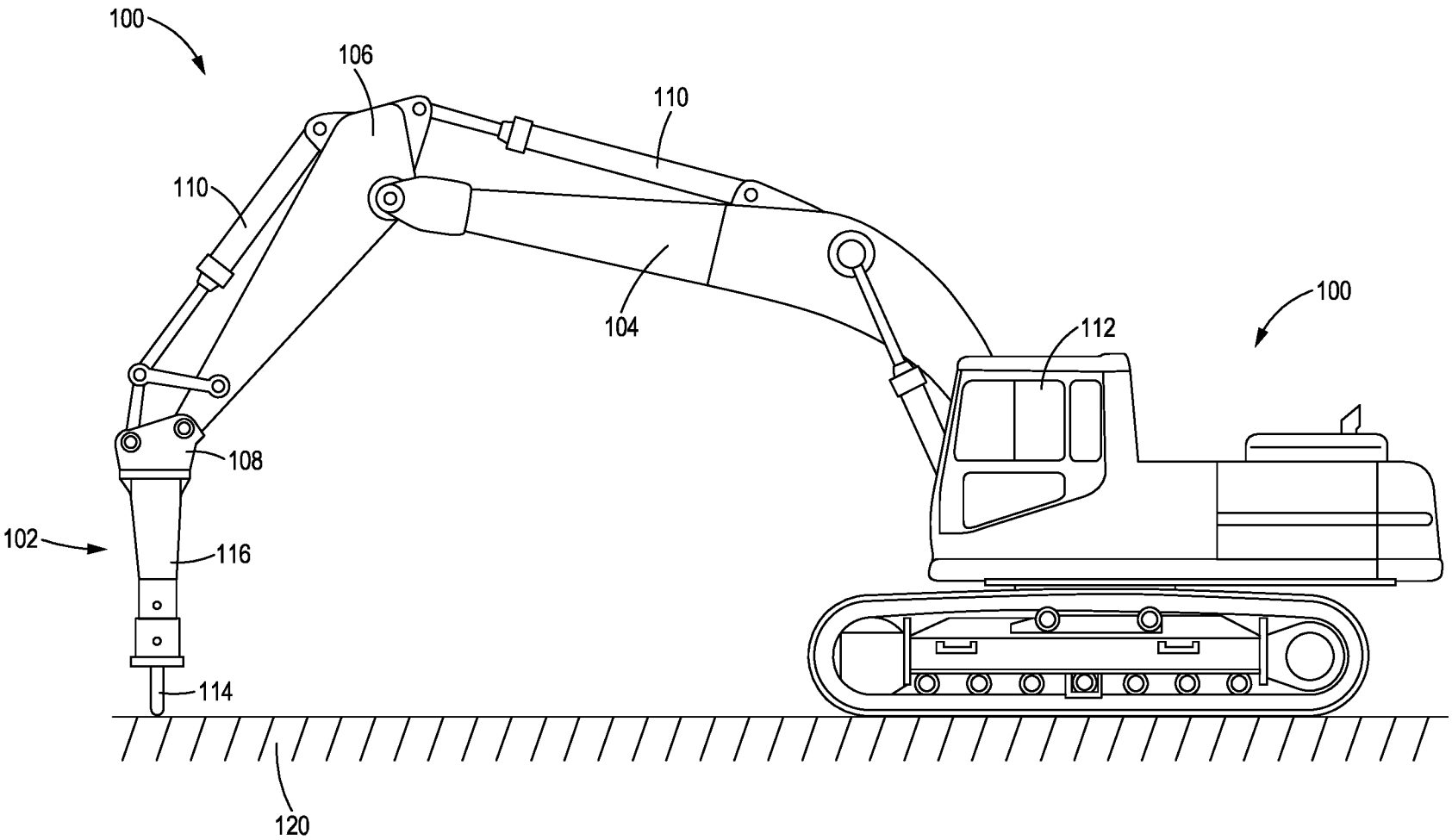
FIG. 1 is a perspective view of an exemplary machine that includes a hydraulic hammer utilizing the teachings of this disclosure.

FIG. 1 illustrates an exemplary work machine 100 that may incorporate a hydraulic hammer assembly, hereinafter referred to as a hammer 102. The work machine 100 may be configured to perform work associated with a particular industry such as, mining or construction. For example, work machine 100 may be a backhoe loader, an excavator (shown in FIG. 1), a skid steer loader, or any other machine. The hammer 102 may be coupled to the work machine 100 via a boom 104, an arm 106 and a pivoting bracket 108 that pivotally connects the hammer 102 to the arm 106. It is contemplated that other linkage arrangements known in the art to connect the hammer 102 to the work machine 100 may alternatively be utilized.

In the disclosed embodiment, one or more hydraulic cylinders 110 may raise, lower, and/or swing the boom 104, the arm 106 and the pivoting bracket 108 to correspondingly raise, lower, and/or swing the hammer 102. The hydraulic cylinders 110 may be connected to a hydraulic supply system (not shown) within the work machine 100. Specifically, the work machine 100 may include a hydraulic pump (not shown) connected to the hydraulic cylinders 110 and to the hammer 102 through one or more hydraulic supply lines (not shown). The hydraulic supply system may introduce pressurized fluid, for example oil, from the pump and into the hydraulic cylinders 110. Operator controls for movement of the hydraulic cylinders 110 and/or the hammer 102 may be located within a cabin 112 of the work machine 100.

Figure 2:
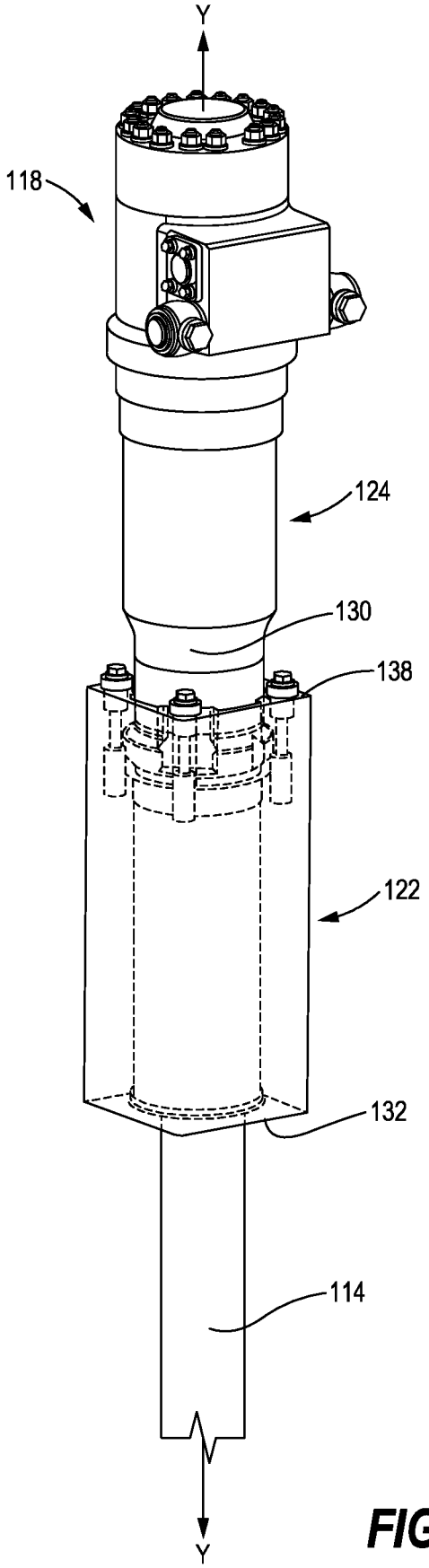
FIG. 2 is a perspective view of an embodiment of the power cell of the exemplary hammer of FIG. 1.

The hammer 102 may include a housing 116, a power cell 118 (FIG. 2) disposed within the housing 116, and a work tool 114 partially disposed within the power cell 118 (e.g., tool channel 152). The work tool 114 is configured to break rocks and/or drill ground surfaces 120 (FIG. 1) when the hammer 102 is operated. In one embodiment, work tool 114 may include or may be a chisel bit. The work tool 114 is operatively connected to a first end of the power cell 118 (FIG. 2) and extends outward from the housing 116 (FIG. 1) at an end of the housing 116 that is disposed opposite to the pivoting bracket 108, which is disposed adjacent to the second end of the power cell 118 (FIG. 2). The pivoting bracket 108 (FIG. 1) may be coupled to the power cell 118 (FIG. 2) by one or more bracket fasteners (not shown).

Figure 3:
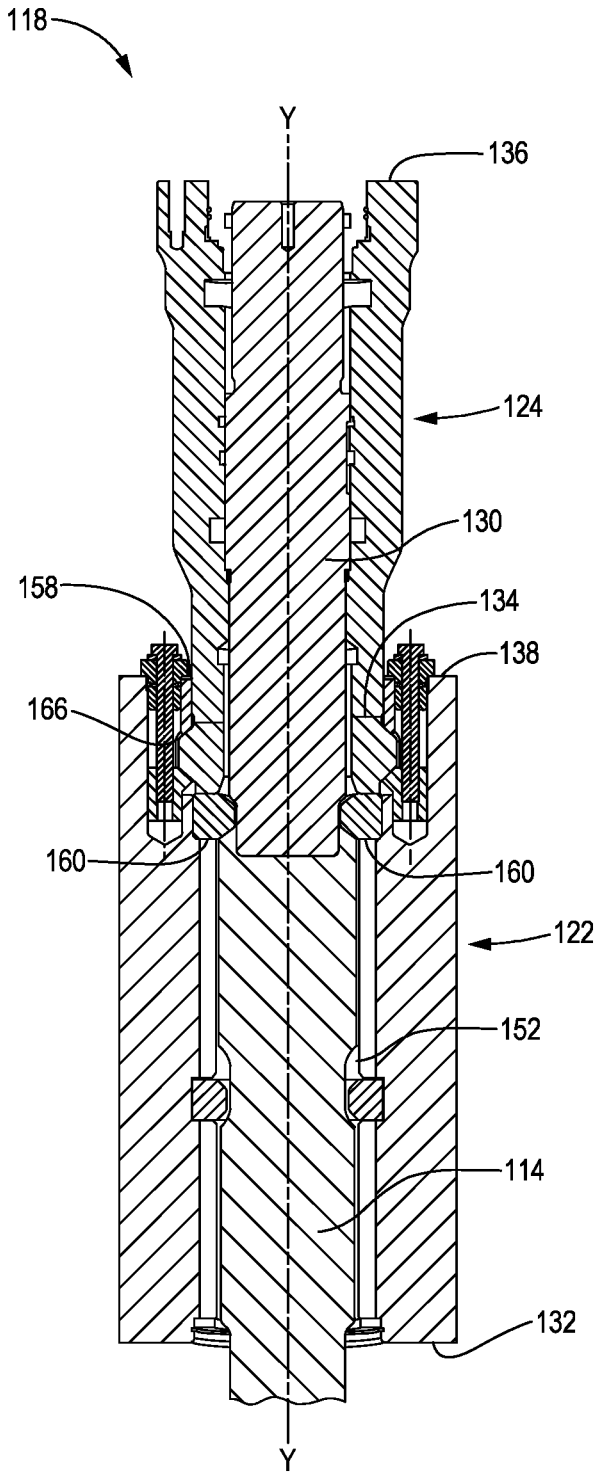
FIG. 3 illustrates a cross section view of a portion of the exemplary embodiment of the power cell.

FIG. 2 illustrates the exemplary power cell 118. The power cell 118 may define a longitudinal axis Y. The power cell 118 is configured to drive the work tool 114 of the hammer 102 (FIG. 1). The power cell 118 (FIG. 2) may comprise a head 122 and a cylinder 124, a piston 130 and a hydraulic circuit (not shown) with other necessary components for actuating the piston 130. The power cell 118 (FIG. 3) may further comprise a sealing member 174. The power cell 118, the head 122, the cylinder 124, the work tool 114 and the piston 130 may be disposed along, and (in some embodiments) centered on, the longitudinal axis Y. The piston 130 is operatively disposed within the power cell 118 (cylinder 124) and is configured to translate parallel to the longitudinal axis Y to drive the work tool 114. The piston 130 is configured to reciprocate in a direction parallel to the longitudinal axis Y within both the head 122 and the cylinder 124 during operation of the hammer 102.

The hammer 102 may be powered by any suitable means, such as pneumatically-powered or hydraulically-powered. For example, a hydraulic or pneumatic circuit (not shown) may provide pressurized fluid to drive the piston 130 towards the work tool 114 during a work stroke and to return the piston 130 during a return stroke.

The piston 130 may be disposed in the cylinder 124 and the head 122 and, in operation, the piston 130 is driven into the end of the work tool 114 that is proximal to the piston 130. The end of the work tool 114 that is distal to the piston 130 is positioned to engage an object or the ground surface 120 (FIG. 1). The impact of the piston 130 on the work tool 114 may cause a shock wave that fractures a hard object (e.g., rock) or ground surface 120 causing it to break apart.

The head 122 has a bottom end 132 and a top end 138. The head 122 may include a main bore 126 (FIG. 6), a plurality of satellite bores 128 disposed at the top end 138 of the head 122, a plurality of lower retainers 176 and a plurality of fasteners 186 (e.g., bolt, threaded bolt, screw, or the like). The head 122 may further include a plurality of upper retainers 192.

In one embodiment, the main bore 126 (FIG. 6) may be centered on (and extend parallel to) the longitudinal axis Y. The main bore 126 has an inner surface 150 and includes an upper chamber 140 disposed adjacent to the top end 138 and a tool channel 152 (best seen in FIG. 3) disposed between the upper chamber 140 (FIG. 6) and the bottom end 132 (FIG. 3) of the head 122. The tool channel 152 is configured to receive the work tool 114. The upper chamber 140 (FIG. 6) comprises a trough 154, a plurality of furrows 156, one or more lock walls 158 (see also FIGS. 3-4) and a shelf 160.

The trough 154 (FIG. 6) is inset into the inner surface 150 and may be generally arcuate or annular in shape. In an embodiment, the trough 154 may be oriented perpendicular to the longitudinal axis Y. The trough 154 includes a floor 162 extending between a pair of opposing side guides 164. The side guides 164 may be angled (e.g., an obtuse angle in relation to the floor 162) or sloped away from the floor 162 and each other. The trough 154 further includes one or more ports 166, each port 166 disposed between a pair of furrows 156. The port 166 is disposed under an adjacent lock wall 158 (FIG. 4) and extends from the floor 162 of the trough 154 of the main bore 126 into the satellite bore 128. A stop (not illustrated) may be formed on the trough 154 such that upon rotation of the cylinder 124 in the upper chamber 140 of the head 122 (as discussed herein later) a protrusion 142 on the cylinder 124 outer surface 144 comes into contact with the stop to indicate that sufficient rotation has taken place.

Each furrow 156 (FIG. 6) is inset into the inner surface 150 and intersects the trough 154. In some embodiments, the furrow 156 may extend from the top end 138 to intersect with the trough 154. In some embodiments, the furrow 156 may extend in a direction generally parallel to the longitudinal axis Y and is oriented generally perpendicular to the trough 154. Each furrow 156 is configured to slidingly receive a protrusion 142 (FIG. 5) of the cylinder 124 and to provide a path for such protrusion 142 to slide into the trough 154 (FIG. 6) when the cylinder 124 (FIG. 5) is inserted into the upper chamber 140 (FIG. 6).

The lock wall 158 is disposed adjacent to the top end 138 and may extend between a pair of furrows 156. The lock wall 158 may further extend from the top end 138 to the port 166. In the exemplary embodiment illustrated in FIG. 6, there are four furrows 156 and four lock walls 158. Each lock wall 158 (FIG. 4) has an upper face 168 and a lower face 170 disposed adjacent to the port 166. The upper face 168 of the lock wall 158 (FIG. 4) may be disposed at the top end 138. The lower face 170 is configured to engage an upper sidewall 172 of a protrusion 142 when the cylinder 124 and head 122 are locked together.

The shelf 160 is configured to receive a sealing member 174 and is disposed below the ports 166. The shelf 160 may be annular in shape. In an embodiment, the sealing member 174 is disposed on the shelf 160 and may be a thrust ring or the like.

Each satellite bore 128 is disposed radially outward of the main bore 126. In some embodiments, the satellite bore 128 may extend parallel to the longitudinal axis B. The satellite bore 128 may have a base 178 opposite to the top end 138 of the head 122. In the exemplary embodiment there are four satellite bores 128 (FIG. 6) spaced equidistantly apart, although in other embodiments, the quantity and spacing may be different.

The lower retainer 176 (FIG. 4) is disposed in the satellite bore 128 (e.g., near a base 178 of such satellite bore 128). Each lower retainer 176 includes a core member 180 and a jut 182. The core member 180 includes a bore 184 configured to receive a fastener 186. In some embodiments, although not all embodiments, the bore 184 may be a threaded bore. The jut 182 includes a contact face 188. The jut 182 extends outward from the core member 180 at an angle (greater than zero). The jut 182 (or a portion thereof) may extend through the port 166 in the trough 154. The jut 182 may be disposed between the top surface 148 of the protrusion 142 and the first end 134 of the cylinder 124. The contact face 188 of the jut 182 is configured to abut (directly or indirectly) against a lower sidewall 190 of the protrusion 142. In one embodiment, the contact face 188 may be configured to directly and flushly abut the lower sidewall 190. The lower retainer 176 is configured to urge the contact face 188 of the jut 182 and a lower sidewall 190 of a protrusion 142 into compressive engagement with one another when the cylinder 124 is in a locked position 200 in the head 122 and a fastener 186 (e.g., bolt, threaded bolt, screw or the like) is received and tightened or secured or screwed in the bore 184 (and tightened).

The upper retainer 192 may be disposed in the satellite bore 128 near the top end 138 of the head 122, and is configured to receive the fastener 186. In one embodiment, the upper retainer 192 may be configured to threadingly receive the fastener 186.

Each fastener 186 is configured to be received by the upper retainer 192 (if any) and lower retainer 176 in the satellite bore 128. The fastener 186 may be a bolt, a threaded bolt, a screw or the like.

The sealing member 174 is configured to be disposed on the shelf 160 in the main bore 126. The sealing member 174 may be annular. For example, the sealing member 174 may be a thrust ring or the like.

Figure 5:
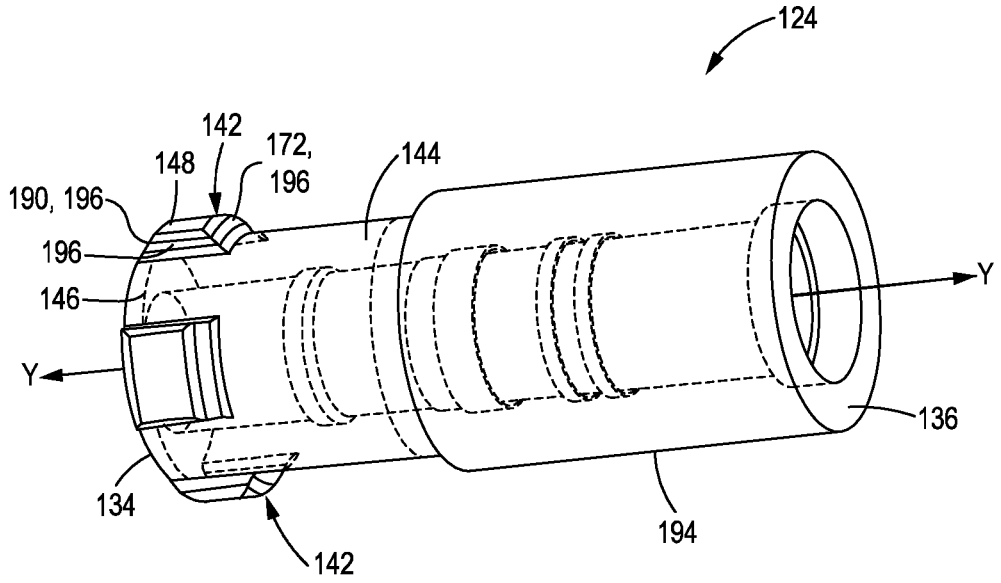
FIG. 5 illustrates a perspective view of the cylinder.
Figure 6:
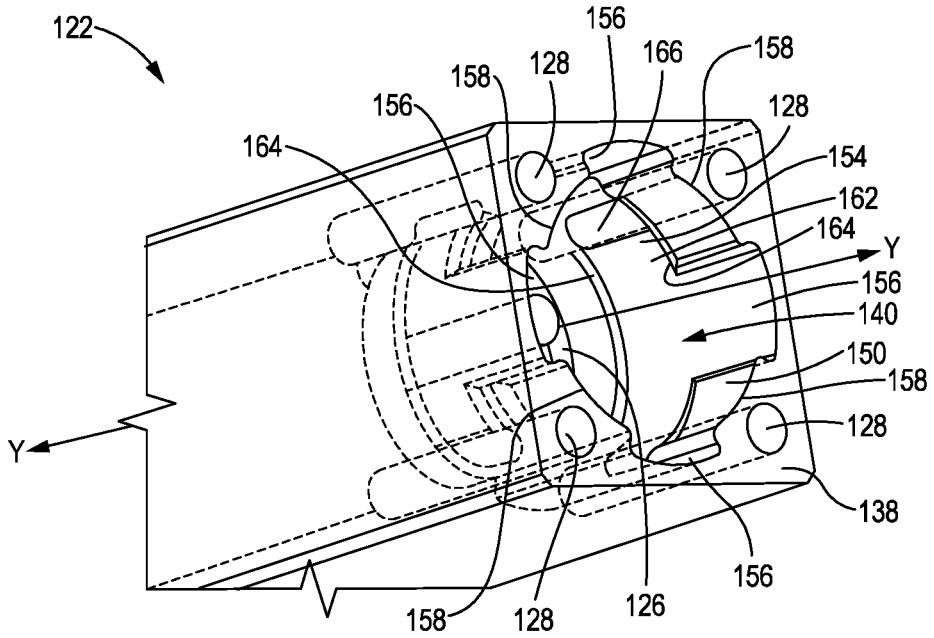
FIG. 6 illustrates a perspective view of the head.

As best seen in FIG. 5, the cylinder 124 includes a body 194 extending along the longitudinal Y axis between a first end 134 and a second end 136. The body 194 is configured to receive the piston 130. The first end 134 of the cylinder 124 is configured to be received in an upper chamber 140 of the head 122. The cylinder 124 further includes one or more protrusions 142 disposed on an outer surface 144 of the body 194. The protrusions 142 may be adjacent to the first end 134. As seen in the exemplary embodiment illustrated in FIG. 5, the cylinder 124 includes four protrusions 142 disposed adjacent to the first end 134 of the cylinder 124. In the exemplary embodiment, each protrusion 142 is configured to extend radially outward from an outer surface 144 of the cylinder 124 through a port 166 of the main bore 126 to the interior of the satellite bore 128. In the exemplary embodiment, the protrusions 142 are disposed equidistantly about the outer circumference 146 of the cylinder 124. The cylinder 124 may be disposed on the sealing member 174.

Each protrusion 142 may include a plurality of sidewalls 196 and a top surface 148. In the exemplary embodiment, some of the sidewalls 196 may be sloped (at an angle greater than zero) toward the top surface 148, and the top surface 148 may be generally flat and may extend from a (first) sidewall 196 to an opposing (second) sidewall 196, thus providing a shape similar to a frusto pyramid. In some embodiments, the sidewalls 196 may be sloped (at an angle greater than zero) and may be generally rounded at the intersection with the top surface 148. In other embodiments, the shape, quantity and spacing of protrusions 142 may vary and are not limited to those illustrated in the exemplary embodiment.

Figures 7A, 7B, 7C:
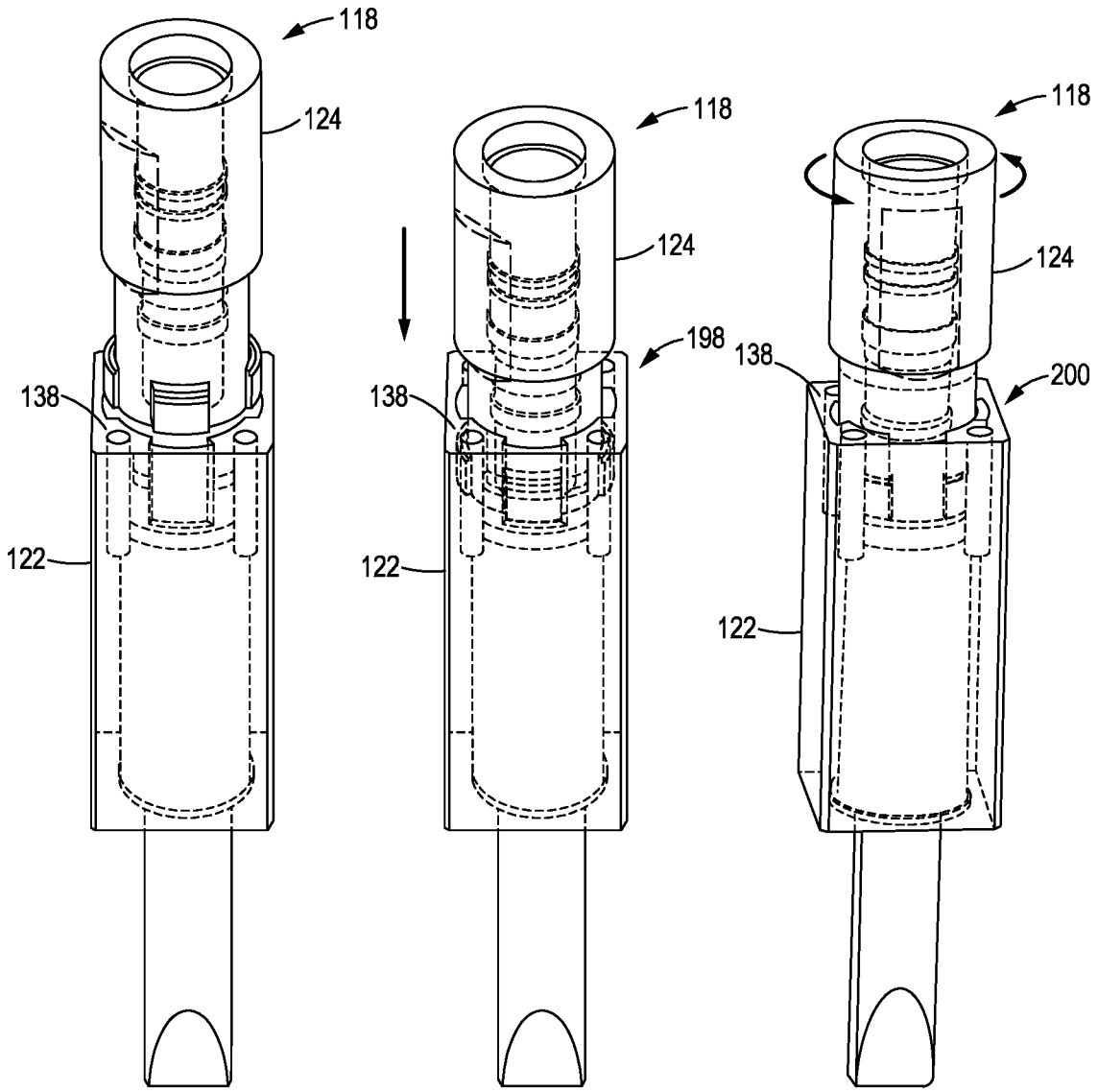
FIG. 7*a* illustrates the cylinder as it is inserted into the head.
FIG. 7*b* illustrates the cylinder inserted in the upper chamber of the head and seated on the sealing member.
FIG. 7*c* illustrates counterclockwise rotation of the cylinder in the upper chamber (e.g., about 45 degrees).

The cylinder 124 is configured to be rotatable in the upper chamber 140 between an unlocked position 198 (FIG. 7*b*) and a locked position 200 (FIG. 7*c*) (and vice versa) when disposed inside the upper chamber 140 of the head 122. When the cylinder 124 is in the locked position 200 and the fastener 186 is received and tightened/secured/screwed in the bore 184 of the core member 180 (e.g., in one embodiment, the fastener may be threadingly received and the bore 184 may be a threaded bore, in other embodiments, the fastener may be received and otherwise secured/tightened), the lower sidewall 190 of the protrusion 142 extends through the port 166 and abuts, and is in compressive engagement with, the contact face 188 of the jut 182, and the upper sidewall 172 of the protrusion 142 abuts, and is in compressive engagement with, the lower face 170 of the lock wall 158.

Also disclosed is a method of assembling a power cell 118, the method comprising: sliding the protrusion 142 of the cylinder 124 into the first furrow 156 until the first end 134 of the cylinder 124 rests against the sealing member 174, rotating the cylinder 124 to the locked position 200 in which the protrusion 142 is disposed in the port 166, and urging the contact face 188 of the jut 182 and a lower sidewall 190 of the protrusion 142 into compressive engagement with one another by tightening or securing or screwing the fastener 186 in the bore 184 of the lower retainer 176. The method further includes urging the upper sidewall 172 into compressive engagement with the lower face 170 of the lock wall 158 by the tightening or securing or screwing of the fastener 186 in the bore 184.

INDUSTRIAL APPLICABILITY

In general, the foregoing disclosure finds utility in machines 100 utilizing hydraulic hammers. Use of the disclosed hydraulic hammer 102 is expected to decrease the overall service time for assembly or disassembly by eliminating use of tie rods and user of special tools associated with tie rods, while increasing the time between service intervals on the hammer 102.

The method of assembly includes aligning the protrusions 142 of the cylinder 124 with the furrows 156 of the head 122, and then inserting each protrusion 142 into a corresponding furrow 156 (see FIG. 7*a*), in a one-to-one correspondence and sliding cylinder 124 and protrusions 142 along the furrows 156 until the first end 134 of the cylinder 124 is seated in the upper chamber 140 (e.g., rests against the top of the sealing member 174 (see FIG. 7*b*)). When seated in the upper chamber 140, the cylinder 124 is in the unlocked position 198.

The method further includes rotating the cylinder 124 from the unlocked position 198 to the locked position 200 (FIG. 7*c*) by rotating the cylinder 124 (e.g., in a counterclockwise direction) until the locked position 200 is reached. In the exemplary embodiment, the cylinder 124 is rotated counterclockwise about 45°, although in other embodiments the degree of rotation may be more or less than 45° until the locked position 200 is reached. Also, in other embodiments, the cylinder 124 may be rotated clockwise to the locked position 200 instead of counterclockwise. When the cylinder 124 is in the locked position 200, the protrusion 142 is disposed in the port 166.

Figure 4:
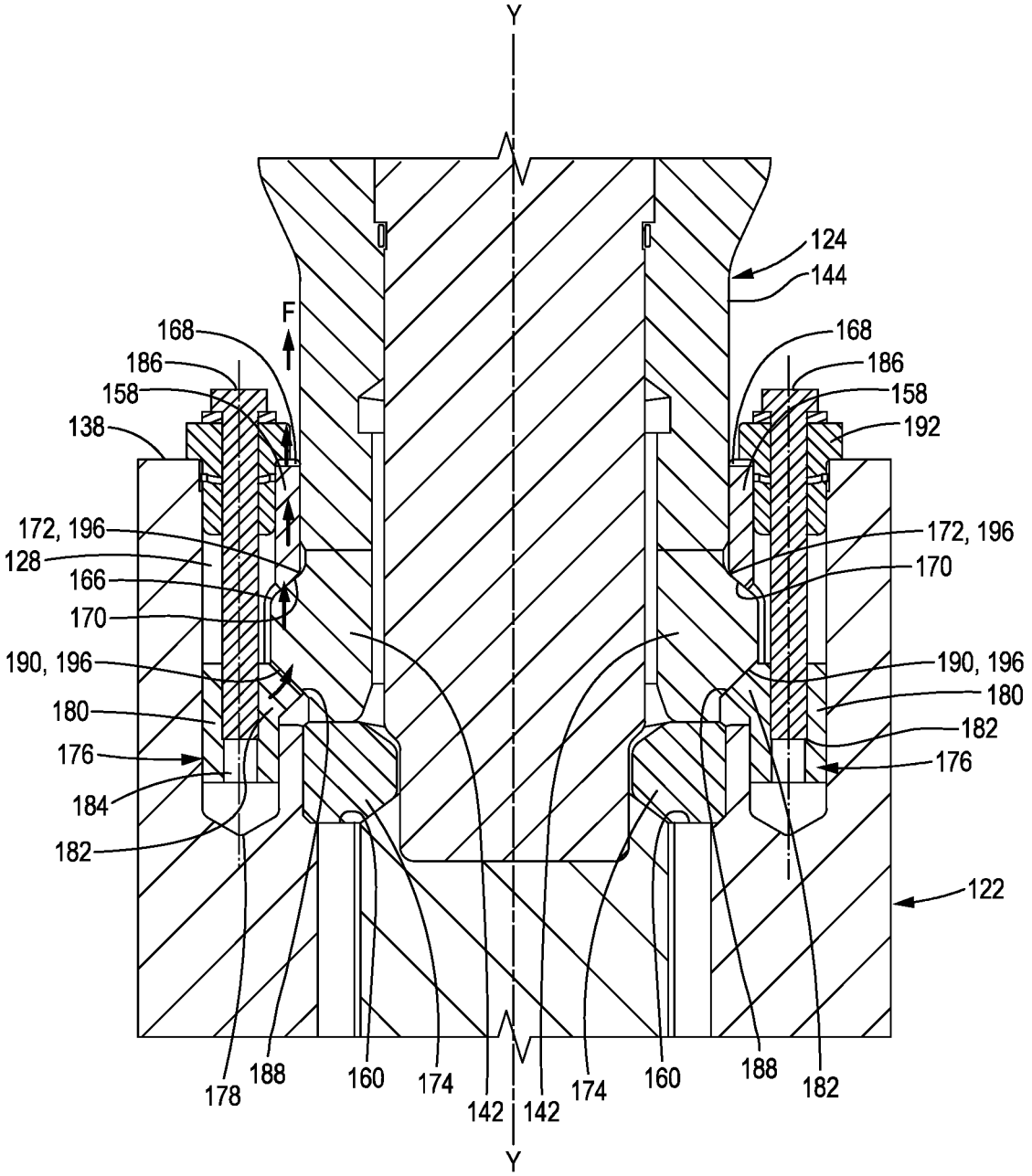
FIG. 4 illustrates an enlarged cross section of a portion of FIG. 3.

The method further includes urging the contact face 188 of the jut 182 and the lower sidewall 190 of the protrusion 142 into compressive engagement with one another by securing or tightening or screwing each fastener 186 into the corresponding bore 184, and urging the upper side wall 172 into compressive engagement with the lower face 170 of the lock wall 158 (see FIG. 4). When in this position, stress forces (F) acting on the head 122 (from tensioning of the fastener 186 to urge the head 122 and cylinder 124 into, and to retain in during operation, compressive engagement with each other) travel through the jut 182 to the protrusion 142 and then through the lock wall 158 for dissipation as illustrated in FIG. 4, instead of through the fastener 186 (or the like).

The cylinder 124 is retained on the head 122 when in the locked position 200 and is slidably removable from the head 122 along the longitudinal axis Y when in the unlocked position 198 and each protrusion 142 is disposed in the corresponding furrow 156.

To remove the cylinder 124 from the head 122, the fasteners 186 may be loosened until the contact face 188 of the jut 182 and the lower sidewall 190 of the protrusion 142 are no longer engaged with one another and the protrusion 142 is slidable in the trough 154. Then, the cylinder 124 may be rotated in the opposite direction (from when locked) until each protrusion 142 is disposed at the intersection of the trough 154 and the corresponding furrow 156. The protrusions 142 may then be slid along the furrow 156 until the cylinder 124 is disposed outside of the head 122.

From the foregoing, it will be appreciated that while only certain embodiments have been set forth for the purposes of illustration, alternatives and modifications will be apparent from the above description to those skilled in the art. These and other alternatives are considered equivalents and within the spirit and scope of this disclosure and the appended claims.

What is claimed is:

1. A power cell of a hammer, the power cell comprising:

a head having a top end and a bottom end, the head including:

a main bore that extends parallel to a longitudinal axis defined by the power cell, the main bore having an inner surface and including an upper chamber disposed adjacent to the top end, the upper chamber including:

a trough inset into the inner surface and including a port that extends from the main bore into a satellite bore disposed in the head;

a first furrow and a second furrow, each of the first and second furrows inset into the inner surface and intersecting the trough; and a lock wall disposed adjacent the top end and extending between the first furrow and the second furrow, the lock wall further extending from the top end to the port;

the satellite bore disposed radially outward of the main bore; and a lower retainer disposed in the satellite bore, the lower retainer including a core member and a jut angled outward from the core member, the core member including a bore configured to receive a fastener;

a cylinder including a body and a protrusion, the body extending between a first end and a second end of the cylinder, the protrusion disposed on an outer surface of the body and adjacent to the first end, the first end of the cylinder disposed in the upper chamber, the cylinder rotatable in the upper chamber from an unlocked position to a locked position, wherein when in the locked position the protrusion is disposed in the port, wherein further when the cylinder is in the locked position and the fastener is received in the bore of the core member, the protrusion abuts the lock wall and the jut; and a piston disposed in the cylinder and configured to translate in a direction parallel to the longitudinal axis.

2. The power cell of claim 1, wherein the first and second furrows extend in a direction perpendicular to the trough or extend from the top end to intersect the trough.

3. The power cell of claim 1, wherein the trough is arcuate in shape and is disposed perpendicular to the longitudinal axis, and the satellite bore extends parallel to the longitudinal axis.

4. The power cell of claim 1, wherein the jut is disposed between a top surface of the protrusion and the first end of the cylinder.

5. The power cell of claim 1, wherein the cylinder is retained on the head when locked and slidably removeable from the head along the longitudinal axis when in the unlocked position and the protrusion is disposed in the first furrow.

6. The power cell of claim 1, in which the upper chamber further includes a shelf.

7. The power cell of claim 6 further including a sealing member disposed on the shelf, wherein the first end of the cylinder is disposed on the sealing member.

8. The power cell of claim 1 further including a fastener disposed in the satellite bore, wherein the fastener is a bolt, a threaded bolt or a screw.

9. A method of assembling a power cell that comprises a head and a cylinder, the head having a top end and including a main bore, a satellite bore, a lower retainer and a sealing member disposed on a shelf, the main bore extending parallel to a longitudinal axis defined by the power cell and having an inner surface, the main bore including an upper chamber disposed adjacent to the top end, the upper chamber including a trough, a first furrow, a second furrow, a lock wall and the shelf, the trough inset into the inner surface and including a port that extends from the main bore into the satellite bore, the first and second furrows inset into the inner surface and intersecting the trough, the lock wall disposed adjacent the top end and extending between the first and second furrows, the lock wall further extending from the top end to the port, the satellite bore disposed radially outward of the main bore, and the lower retainer disposed in the satellite bore and including a core member and a jut angled outward from the core member, the core member including a bore configured to receive a fastener, the cylinder including a body and a protrusion, the body extending between a first end and a second end of the cylinder, the protrusion disposed on an outer surface of the body and adjacent to the first end, the first end of the cylinder disposed in the upper chamber, the cylinder rotatable in the upper chamber from an unlocked position to a locked position, wherein when the cylinder is in the locked position and the fastener is received in the bore of the core member, the protrusion abuts the lock wall and the jut, wherein the fastener is a bolt, a threaded bolt or a screw, the method comprising:

sliding the protrusion of the cylinder into the first furrow until the first end of the cylinder rests against the sealing member;

rotating the cylinder to the locked position in which the protrusion is disposed in the port; and urging the a contact face of the jut and a first sidewall of the protrusion into compressive engagement with one another by tightening the fastener in the bore of the lower retainer.

10. The method of claim 9, wherein the bore of the lower retainer is a threaded bore, wherein the tightening comprises screwing the fastener into the threaded bore of the lower retainer, the method further comprising urging a second sidewall of the protrusion into compressive engagement with a lower face of the lock wall by the screwing of the fastener into the threaded bore.

11. The method of claim 10, wherein the first furrow extends in a direction perpendicular to the trough.

12. The method of claim 10, wherein the trough is arcuate in shape and is disposed perpendicular to the longitudinal axis.

13. The method of claim 12, wherein the protrusion is frusto pyramid shaped.

14. The method of claim 13, wherein the first furrow is perpendicular to the trough.

15. A hammer comprising:

a housing; and a power cell disposed in the housing and defining a longitudinal axis, the power cell comprising:

a head having a top end and a bottom end, the head including:

a main bore that extends parallel to the longitudinal axis, the main bore having an inner surface and including an upper chamber disposed adjacent to the top end and a tool channel extending from the upper chamber to the bottom end of the head, the tool channel configured to receive a work tool, the upper chamber including:

a trough inset into the inner surface and including a port that extends from the main bore into a satellite bore;

a first furrow and a second furrow, each of the first and second furrows inset into the inner surface and extending from the top end to intersect the trough; and a lock wall disposed adjacent the top end and extending between the first furrow and the second furrow, the lock wall including an upper face disposed at the top end and a lower face disposed adjacent to the port;

the satellite bore disposed radially outward of the main bore and extending parallel to the longitudinal axis; and a lower retainer disposed in the satellite bore, the lower retainer including a core member and a jut angled outward from the core member, the jut including a contact face, the core member including a threaded bore configured to receive a fastener, the lower retainer configured to urge the contact face of the jut and a first sidewall of a protrusion into compressive engagement with one another when a fastener is threadingly received in the threaded bore and a cylinder is in a locked position;

the cylinder including a body and the protrusion, the body extending between a first end and a second end of the cylinder, the protrusion disposed on an outer surface of the body and adjacent to the first end, the first end disposed inside the upper chamber, the protrusion including a top surface extending from the first sidewall to a second sidewall, the protrusion extending through the port, the cylinder rotatable in the upper chamber from an unlocked position to the locked position, wherein when the cylinder is in the locked position and the fastener is threadingly received in the threaded bore of the core member, the first sidewall of the protrusion extends through the port and is in compressive engagement with the contact face of the jut and the second sidewall of the protrusion is in compressive engagement with the lower face of the lock wall; and a piston disposed in the cylinder and configured to translate in a direction parallel to the longitudinal axis, wherein the fastener is a bolt, a threaded bolt or a screw.

16. The hammer of claim 15 further comprising a work tool disposed in the tool channel.

17. The hammer of claim 15, in which the upper chamber further comprises a shelf, and the hammer further comprises a sealing member disposed on the shelf, wherein the cylinder is disposed on the sealing member.

18. The hammer of claim 15, wherein the first sidewall is sloped and the second sidewall is sloped.

19. The hammer of claim 15, wherein the protrusion is frusto pyramid shaped.

20. The hammer of claim 15, wherein at least a portion of the jut extends into the port.

* * * * *